United States Patent [19]

Bessinger et al.

[11] Patent Number: 4,605,265

[45] Date of Patent: Aug. 12, 1986

[54] DRAWER SLIDE BUMPER

[75] Inventors: Walter L. Bessinger, Grand Haven; Jerry D. Rutledge, Grand Rapids, both of Mich.

[73] Assignee: Knape & Vogt Manufacturing Company, Grand Rapids, Mich.

[21] Appl. No.: 642,111

[22] Filed: Aug. 20, 1984

[51] Int. Cl.[4] ..... A47B 88/00; A47B 95/00; F16C 29/00

[52] U.S. Cl. ..... 384/20; 248/345.1; 312/311; 312/348

[58] Field of Search ..... 308/3.6, 3.8; 312/311, 312/346, 348; 248/345.1

[56] References Cited

U.S. PATENT DOCUMENTS

| | | | |
|---|---|---|---|
| 2,757,051 | 7/1956 | Wilmer et al. | 308/3.6 |
| 2,951,252 | 9/1960 | Roche | 5/279 |
| 3,059,978 | 10/1962 | Fall | 308/3.6 |
| 3,205,025 | 9/1965 | Jordan | 308/3.8 |
| 3,260,491 | 7/1966 | Goode | 248/345.1 |
| 3,377,115 | 4/1968 | Hansen et al. | 312/330 |
| 3,773,395 | 11/1973 | Antonaccio | 308/3.8 |
| 3,850,482 | 11/1974 | Gutner | 308/3.6 |
| 4,437,715 | 3/1984 | Jenkins | 312/311 X |

*Primary Examiner*—Stuart S. Levy
*Assistant Examiner*—David Werner
*Attorney, Agent, or Firm*—Price, Heneveld, Huizenga & Cooper

[57] ABSTRACT

The specification discloses a one-piece polymeric bumper to be installed on the forward end of a drawer slide to prevent the slide from marking the door of a cabinet in which the slide is mounted. The bumper includes a body abutting the end of a drawer rail, a pair of legs telescoped over the rail, and an arm telescoped into the rail and secured therein.

20 Claims, 6 Drawing Figures

DRAWER SLIDE BUMPER

BACKGROUND OF THE INVENTION

The present invention relates to drawer slides, and more particularly to a drawer slide having a bumper mounted in the forward end thereof to engage a cabinet door and thereby prevent the slide from marking the door.

A wide variety of drawer slides has been developed for mounting drawer boxes within cabinets. Typically, the slide includes a drawer rail secured to the drawer box, a cabinet rail secured to the cabinet, and roller structure for slidably interfitting the two rails to slidably suspend the drawer box within the cabinet. The structure of the rails can be varied in accordance with well-known techniques to make the drawer self-closing, self-opening, or self-locking, or to have other characteristics.

Often, the cabinets in which drawers are so mounted include doors covering the cabinet opening. If the drawer is withdrawn from the cabinet before the cabinet door is fully open, the drawer rail and/or drawer engage, mar, and/or mark the door. The roll-formed drawer rails include sharp exposed corners which can cut quite deeply into the cabinet door. If the user is not extremely careful, the cabinet door will eventually have a deep scratch along its inside surface where the drawer rail engages the door. Scratching can also occur if the door is closed before the drawer is completely closed.

One prior artisan has developed a rudimentary solution to this problem by staking a rubber bumper within the forward end of the drawer rail of the slide assembly. The rail in which the bumper is mounted is C-shaped in cross section including a web portion and a pair of flanges extending generally transversely therefrom. Both flanges are cut back from the rail end to accommodate the rubber bumper, which is staked to the rail by a rivet. The bumper includes a body overlying the web portion and a pair of shoulders abutting the cutaway flanges. The bumper, rather than the metal rail itself, engages the cabinet door to prevent marring thereof. This bumper/rail is manufactured and sold by Vogt Industries, Inc., of Grand Rapids, Michigan. However, this construction is not without its drawbacks. First, the bumper is relatively easily dislodged from its desired position at the end of the rail. Second, the rail end must be specially stamped or machined to receive the bumper. Third, the relatively high coefficient of friction of the rubber bumper causes the bumper to drag along the cabinet door and inhibit the smooth and easy operation of the drawer.

SUMMARY OF THE INVENTION

The aforementioned problems are overcome in the present invention. Essentially, a one-piece, polymeric drawer slide bumper is provided which can be simply, yet securely and positively, mounted at the end of a drawer rail. More particularly, the bumper includes a body abutting the rail end, a pair of legs extending from the body and abuttingly overlying the outer rail surface, and a securing arm extending from the bumper body and abuttingly overlying the inner rail surface. Securing structure is also provided for axially interlocking the bumper and drawer rail to secure the bumper on the rail.

The bumper is easily installed on the drawer rail by telescoping the bumper legs along the outer rail surface and the bumper arm along the inner rail surface until the bumper body abuts the rail end. The securing means insures that the bumper is properly secured in position. The bumper, which engages both the outer and inner sides of the drawer rail, is securely positioned on the rail end and extremely difficult to dislodge. The polymeric material of which the bumper is fabricated has a relatively low coefficient of friction and therefore rides easily against a cabinet door when engaging same. Further, the one-piece polymeric bumper is relatively easily and inexpensively manufactured.

These and other objects, advantages, and features of the invention will be more readily understood and appreciated by reference to the detailed description of the preferred embodiments and the drawings.

DETAILED DESCRIPTION OF THE PREFERRED EMBODIMENT

Figure 1:
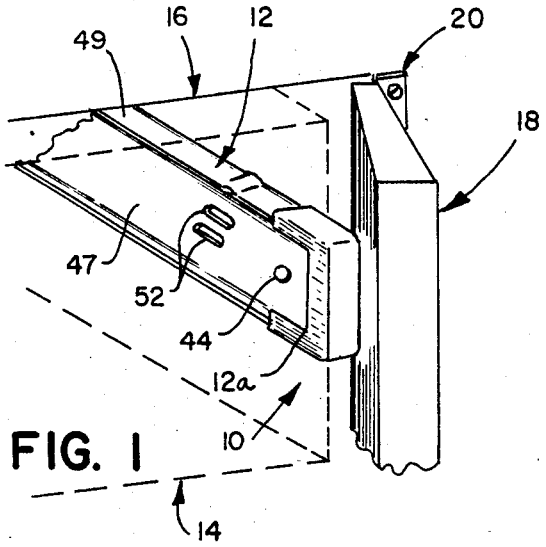
FIG. 1 is a fragmentary perspective view of the drawer slide bumper of the present invention mounted on a drawer slide within a cabinet.
Figure 2:
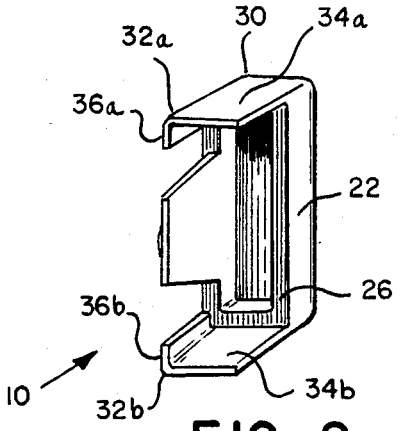
FIG. 2 is a perspective view of the bumper.

A drawer slide bumper constructed in accordance with a preferred aspect of the invention is illustrated in the drawings and generally designated 10. The polymeric bumper is mounted on drawer rail 12 of a drawer slide assembly (not fully shown) used to mount drawer box 14 within cabinet 16. The cabinet includes door 18 mounted thereon using hinge 20 to selectively cover the cabinet opening. If drawer 14 is withdrawn from cabinet 16 without door 18 being fully open, bumper 10 engages the door to prevent rail 12 from marking or marring the door. The low coefficient of friction of polymeric bumper 10 enables the bumper to ride easily against door 18 to gently push the door out of the way as drawer box 14 is withdrawn.

Bumper 10 is preferably a one-piece polymeric member fabricated of a thermoplastic polyamide resin. For example, in the preferred embodiment, bumper 10 is injection-molded of a general purpose type-66 nylon sold by DuPont under either of the designations ZYTEL 101F NC-10 or ZYTEL 101L NC-10. These materials have relatively low coefficients of friction as opposed to rubber; and therefore bumper 10 slides smoothly against cabinet door 18.

Bumper 10 (FIGS. 2-5) includes body portion 22 having a forward face 24 and opposite abutment face or surface 26, which are generally parallel one another. A rectangular recess 28 is formed in body 22 to core bumper 10, facilitating injection molding. This recess provides a convenient position in which a manufacturer identifying indicia or part number can be molded either in recessed or raised letters. Body 22 includes gently rounded corner 30 extending the full height of the body opposite arm 40. Bumper body 22 extends the full width and height of rail 12 (FIG. 4) to cover rail end 12*a*.

Upper and lower legs 32*a* and 32*b* are generally J-shaped in cross section and extend generally perpendicularly from abutment face 26 of body 22. Upper leg 32*a* includes top portion 34*a* and side portion 36*a* forming the J-shaped cross section. Similarly, lower leg 32*b* includes bottom portion 34*b* and side portion 36*b* defining its J-shaped cross section. The intersection of portions 34 and 36 of each of legs 32*a* and 32*b* is gently rounded. Leading edges 38*a* and 38*b* of legs 32*a* and 32*b*, respectively, are beveled to facilitate installation of the bumper on a drawer rail.

Retention arm 40 is generally trapezoidal in side view (FIG. 3) and includes beveled leading edge 42. Circular barb 44 is positioned on arm 40 adjacent leading edge 42 enabling the bumper to be snap-fitted in the drawer rail.

Rail 12 (FIGS. 3 and 4) is generally well-known to those having ordinary skill in the art and is commercially available from the assignee of the present application as part of a Model 1300 drawer slide. Rail 12 is generally C-shaped in cross section including inner surface or side 47 and outer surface or side 49. Web 50 includes apertures 52 (see FIG. 1) which receive fasteners to secure the rail to a drawer box. Rail 12 further comprises top and bottom flanges 54*a* and 54*b* which are both oriented generally perpendicularly to web 50. Flange 54*a* is connected to web portion 50 via V portion 56*a* which imparts a reverse bend or reverse V to the drawer rail at the corners of the C section. Similarly, reverse V section 56*b* interconnects lower flange 54*b* with web 50. V portion 56*a* includes a pair of perpendicular legs 58*a* and 60*a;* V portion 56*b* includes a pair of generally perpendicular legs 58*b* and 60*b*. Rail end 12*a* is perpendicular to the longitudinal axis of the rail and is straight from top to bottom. Circular aperture or detent 53 extends through web 50 to receive bumper barb 44. Preferably the distance between rail end 12*a* and aperture 53 is generally identical to the distance between abutment face 26 and barb 44.

Assembly and Operation

Bumper 10 is formed by injection molding; and rail 12 of the drawer slide assembly is fabricated using well-known techniques.

Figure 3:
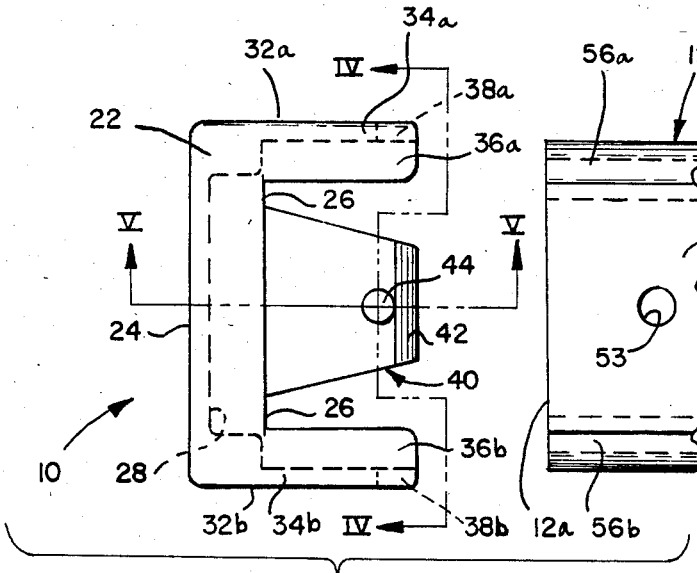
FIG. 3 is an exploded side view of the bumper and rail.
Figure 4:
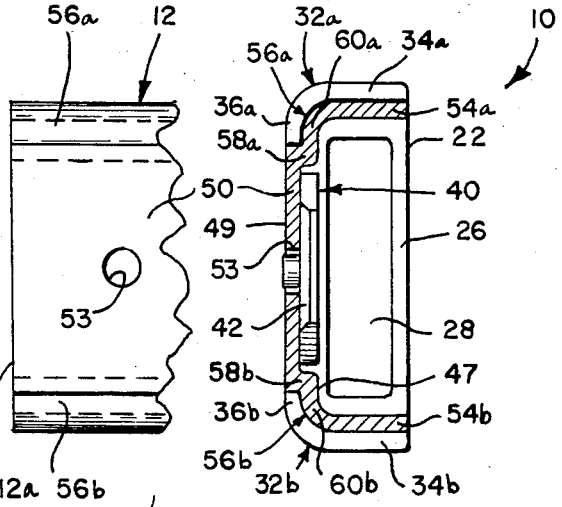
FIG. 4 is a sectional view taken along plane IV—IV in FIG. 3.
Figure 5:
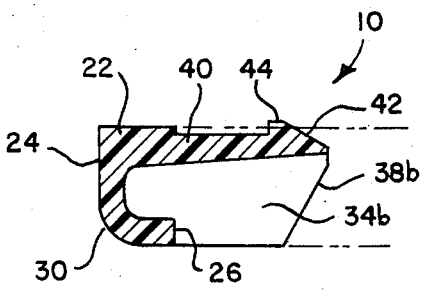
FIG. 5 is a sectional view taken along plane V—V in FIG. 3.

The bumper is installed on rail end 12*a* by aligning bumper 10 with rail 12 as illustrated in FIG. 3. The bumper is then moved axially onto rail 12 with legs 32*a* and 32*b* interfitting with outer side 49. Beveled edge 42 of arm 40 engages inner side 47 of rail end 12*a* to slightly flex arm 40 permitting barb 44 to ride along the inner side of the rail. Beveled edges 38*a* and 38*b* of arms 32*a* and 32*b*, respectively, facilitate telescoping these arms over the outer side 49 of rail 12. Bumper 10 is slid onto rail 12 until abutment surface 26 engages rail end 12*a*, at which time barb 44 snaps into aperture or detent 53 in rail 12 under the resilient force of arm 40. Barb 44 and aperture 53 prevent the subsequent unintentional axial movement of bumper 10 with respect to rail 12.

Bumper 10 closely interfits with drawer rail 12 when fully mounted thereon. Upper bumper leg 32*a* closely follows the contour of the upper portion of the rail, with leg portion 34*a* overlying top flange 54*a* and with leg portion 36*a* extending into V portion 56*a*. Lower bumper leg 32*b* similarly closely follows the contour of the lower portion of the rail. The bumper does not interfere with the mounting of the rail on the drawer box because the bumper does not extend beyond web 50 in the direction of the drawer box.

As illustrated in FIG. 1, installed bumper 10 simply, yet effectively and securely, protects cabinet door 18 from the otherwise exposed rail end 12*a*. If drawer box 14 is withdrawn from cabinet 16 before drawer 18 is fully open, bumper 10 and more particularly rounded corner 30 of body portion 22 engages the cabinet drawer to prevent marring or marking thereof. The relatively low coefficient of friction of the polymeric member permits the bumper to ride smoothly and easily along the cabinet door. The tight interfitting of the bumper 10 with rail 12 (see particularly FIG. 4) greatly reduces the possibility that the bumper will be inadvertently knocked off the rail end. Legs 32*a* and 32*b* of bumper 10 abuttingly overlie the outer side 49 of rail 12 while arm 40 abuttingly overlies the inner side 47 of the rail.

Alternative Embodiment

Figure 6:
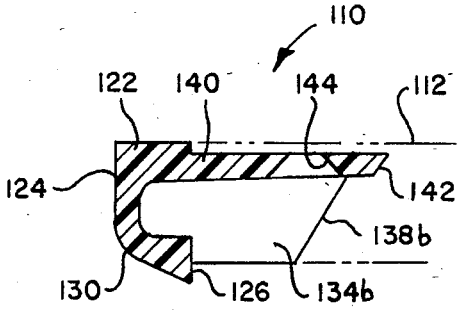
FIG. 6 is a sectional view similar to FIG. 5 of an alternative embodiment of the bumper.

An alternative embodiment 110, and currently the preferred embodiment, of the bumper is illustrated in FIG. 6 and is generally similar to bumper 10 previously described with the exceptions of abutment face 126 and arm 140. Abutment face 126 is slightly wider than portion 134*b* to extend slightly outwardly therefrom which further insures that rail 112 does not engage the cabinet door. The barb 44 of arm 40 is replaced by beveled hole 144 in arm 140 which receives a flat head screw (not shown) to secure bumper 110 to rail 112. Leading edge 142 of arm 140 is tapered in a direction opposite to leading edge 42 to permit the roller (not shown) riding within rail 112 to easily pass beside arm 140. The remaining structure and function of alternative bumper 110 are generally identical to bumper 10.

The above descriptions are those of preferred embodiments of the invention. Various alterations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A drawer rail assembly comprising:

a generally C-shaped rail including inner and outer surfaces, a web portion to be secured to a drawer, upper and lower flanges extending transversely from said web portion, and upper and lower V-shaped connector portions extending between said web portion and said upper and lower flanges, respectively, whereby said rail has reverse bends at the two corners of its C-shape; and a one-piece bumper mounted on the end of said rail, said bumper including a body portion abutting the end of the rail, upper and lower legs overlying said outer rail surface and interfitting within said upper and lower V-shaped connector portions, respectively, and connector means for preventing relative longitudinal movement of said bumper and said rail.

2. A drawer rail assembly as defined in claim 1 wherein said end of said rail is cut generally perpendicularly to the longitudinal axis of said rail.

3. A drawer rail assembly as defined in claim 1 wherein said body extends the full height and width of said rail to cover said rail end.

4. A drawer rail assembly as defined in claim 1 wherein said bumper body portion includes a gently rounded corner extending the full height of said body portion.

5. A drawer rail assembly as defined in claim 1 wherein said bumper further includes an arm overlying said inner rail surface and abutting said web portion within said C-shaped rail.

6. A drawer rail assembly as defined in claim 5 wherein said connector means comprises a barb on said bumper arm interfitting with detent means on said rail.

7. A drawer rail assembly as defined in claim 5 wherein said connector means comprises a fastener extending through said bumper arm and said rail web portion.

8. A drawer rail assembly comprising:

a generally C-shaped rail including a web portion to be secured to a drawer, upper and lower flanges extending transversely therefrom, and upper and lower V-shaped connector portions extending between said web portion and said upper and lower flanges, respectively, whereby said rail has reverse bends at the two corners of its C-shape; and a one-piece bumper mounted on the end of said rail, said bumper including a body portion abutting the end of the rail, upper and lower legs interfitting within said upper and lower connector portions, respectively, an arm abutting said web portion within said rail, and connector means for securing said bumper to said rail, each of said upper and lower bumper legs having a first portion positioned within said V-shaped connector portion and a second portion overlying the associated rail flange.

9. A drawer rail assembly comprising:

a generally C-shaped drawer rail having interior and exterior surfaces, an end, and upper and lower flanges;

a one-piece bumper mounted on said rail end, said bumper including a pair of legs overlying said exterior rail surface and abuttingly overlying said rail flanges, said bumper further including a body abutting said rail end; and securing means for preventing relative axial movement of said bumper and said rail.

10. A drawer rail assembly as defined in claim 9 wherein said bumper further includes an arm overlying said inner rail surface.

11. A drawer rail assembly comprising:

a generally C-shaped drawer rail having interior and exterior surfaces, an end, and upper and lower flanges;

a one-piece bumper mounted on said rail end, said bumper including a pair of legs overlying said outer rail surface and abuttingly overlying said rail flanges, an arm overlying said inner rail surface, and a body abutting said rail end; and securing means for preventing relative axial movement of said bumper and said rail.

12. A drawer rail assembly as defined in claim 11 wherein said bumper body extends the full height and width of said rail to cover said rail end.

13. A drawer rail assembly as defined in claim 11 wherein said rail further includes a web extending between said upper and lower flanges and further wherein said bumper arm abuttingly overlies said rail web.

14. A drawer rail assembly as defined in claim 13 wherein said securing means comprises:

said web defining a detent; and a barb on said bumper arm locked in said detent.

15. A drawer rail assembly as defined in claim 13 wherein said securing means comprises a fastener extending through said bumper arm and said rail web.

16. A drawer rail assembly comprising:

a generally C-shaped drawer rail having interior and exterior surfaces, an end, and reverse bends at the two corners of said C-shape to define grooves;

a one-piece bumper mounted on said rail end, said bumper including a pair of legs overlying said outer rail surface and interfitting with said corner grooves, an arm overlying said inner rail surface, and a body abutting said rail end; and securing means for preventing relative axial movement of said bumper and said rail.

17. A one-piece drawer rail bumper comprising:

a body portion defining an abutment surface to engage the end of a drawer rail;

a pair of spaced legs extending from said body portion, said legs being generally perpendicular to said abutment surface; and an arm extending from said body portion in generally the same direction as said legs, said arm being generally perpendicular to said abutment surface, said arm being positioned approximately midway between said spaced legs, said arm and legs being positioned to engage opposite sides of the drawer rail.

18. A drawer rail bumper as defined in claim 17 wherein said arm is resilient and includes a barb to snap fit with a detent on the rail.

19. A drawer rail bumper as defined in claim 17 wherein said body portion includes a gently rounded corner extending the full height thereof.

20. A one-piece drawer rail bumper comprising:

a body portion defining an abutment surface to engage the end of a drawer rail;

a pair of spaced legs extending from said body portion, each of said legs being generally J-shaped in cross section and generally perpendicular to said abutment surface; and an arm extending from said body portion, said arm being generally perpendicular to said abutment surface, said arm being positioned approximately midway between said spaced legs, said arm and legs being positioned to engage opposite sides of the drawer rail.

* * * * *